US005987919A

United States Patent [19]

Hooser

[11] Patent Number: 5,987,919

[45] Date of Patent: Nov. 23, 1999

[54] MOURNING RING CONSTRUCTION

[76] Inventor: Irma Hooser, 92 Midvale La., Willingboro, N.J. 08046

[21] Appl. No.: 09/157,045

[22] Filed: Sep. 18, 1998

[51] Int. Cl.[6] ..... A44C 9/00

[52] U.S. Cl. ..... 63/15; 63/1.14; 63/15.2

[58] Field of Search ..... 63/1.11, 1.14, 63/15, 15.1, 15.2, 15.3, 15.4, 15.5, 15.6, 15.65, 15.7

[56] References Cited

U.S. PATENT DOCUMENTS

| | | | |
|---|---|---|---|
| 307,869 | 11/1884 | Place et al. | 63/15.5 |
| 581,549 | 4/1897 | Goetz | 63/15.4 X |
| 1,003,696 | 9/1911 | Briggs | 63/15.7 X |
| 1,325,840 | 12/1919 | Feagans | 63/15 |
| 1,586,606 | 6/1926 | Cain | 63/15.4 X |
| 1,691,445 | 11/1928 | Meliodon | 63/15 X |
| 1,814,467 | 7/1931 | Cedar | 63/15 |
| 2,128,644 | 8/1938 | Gittler | 63/15 |
| 2,146,426 | 2/1939 | Gittler | 63/15 |
| 2,182,876 | 12/1939 | Moldenhauer | 63/15 |
| 2,827,309 | 3/1958 | Fred | 63/1.14 X |
| 3,423,956 | 1/1969 | Manne | 63/15.45 |
| 3,609,993 | 10/1971 | Graf | 63/15.65 |
| 3,678,705 | 7/1972 | Korwin | 63/18 |
| 3,890,801 | 6/1975 | Newman | 63/15.65 |
| 4,989,420 | 2/1991 | Reinhold et al. | 63/1.14 X |
| 5,131,243 | 7/1992 | Coleman | 63/15.65 |
| 5,193,360 | 3/1993 | Lovegrove | 63/15 |
| 5,253,490 | 10/1993 | Doganay | 63/15 X |
| 5,412,956 | 5/1995 | Levy | 63/15.65 |

FOREIGN PATENT DOCUMENTS

| | | | |
|---|---|---|---|
| 760792 | 3/1934 | France | 63/1.1 |
| 2693880 | 1/1994 | France | 63/15 |
| 804 | 1/1909 | United Kingdom | 63/15 |

*Primary Examiner*—Terry Lee Melius
*Assistant Examiner*—Andrea Chop
*Attorney, Agent, or Firm*—Henderson & Sturm

[57] ABSTRACT

A ring construction 10 for providing a visual indication that the wearer is mourning or otherwise honoring the memory of a deceased loved one. The ring construction 10 includes a generally C-shaped ring body member 20 provided with a slidable sleeve member 30 that acts as a closure for the peripheral opening 21 in the ring body member 20. The sleeve member 30 is provided with a loop element 32 adapted to be operatively engaged by a length of chain 50 for joining two identical ring constructions 10, 10' together.

4 Claims, 1 Drawing Sheet

MOURNING RING CONSTRUCTION

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of jewelry in general, and in particular to a mourning ring construction that is designed to perpetuate the memory of a departed loved one.

2. Description of Related Art

As can be seen by reference to the following U.S. Pat. Nos. 3,609,993; 3,890,801; 5,131,243; 5,412,956; and 3,423,956, the prior art is replete with myriad and diverse ring constructions.

While all of the aforementioned prior art constructions are more than adequate for the basic purpose and function for which they have been specifically designed, they are uniformly deficient with respect to their failure to provide a simple, efficient, and practical ring construction that not only alerts others to the fact that a loved one has passed away, but also contains a hidden message relative to the deceased that will offer solace and comfort to the bereaved.

As it stands right now, there is no practical way for an individual to silently signal to a casual observer that they are in mourning and/or that their spouse is deceased.

As a consequence of the foregoing situation, there has existed a longstanding need for a new type of ring construction that will serve as a silent visual indicator to others that the person wearing the ring is either in mourning and/or their spouse is deceased, and the provision of such a construction is a stated objective of the present invention.

BRIEF SUMMARY OF THE INVENTION

Briefly stated, the mourning ring construction that forms the basis of the present invention comprises in general, a ring body unit having a closure unit and a hidden message unit and further provided with a connector unit for attaching two identical ring constructions together in a flanking relationship relative to a wedding ring to indicate the passing of a spouse.

As will be explained in greater detail further on in the specification, the ring body unit is preferably solid black in color to indicate mourning and comprises a generally C-shaped ring body member.

The closure unit comprises a sleeve member that is slidably disposed over the peripheral opening in the ring body member which allows the size of the central ring opening to be expanded and the sleeve member is further provided with a loop element which is adapted to be engaged by one end of the connector unit.

In addition, the ring body member is further provided with an interior compartment dimensioned to accommodate the hidden message unit which comprises a message strip dimensioned to be received within the compartment and a closure element adapted to selectively uncover the message strip.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
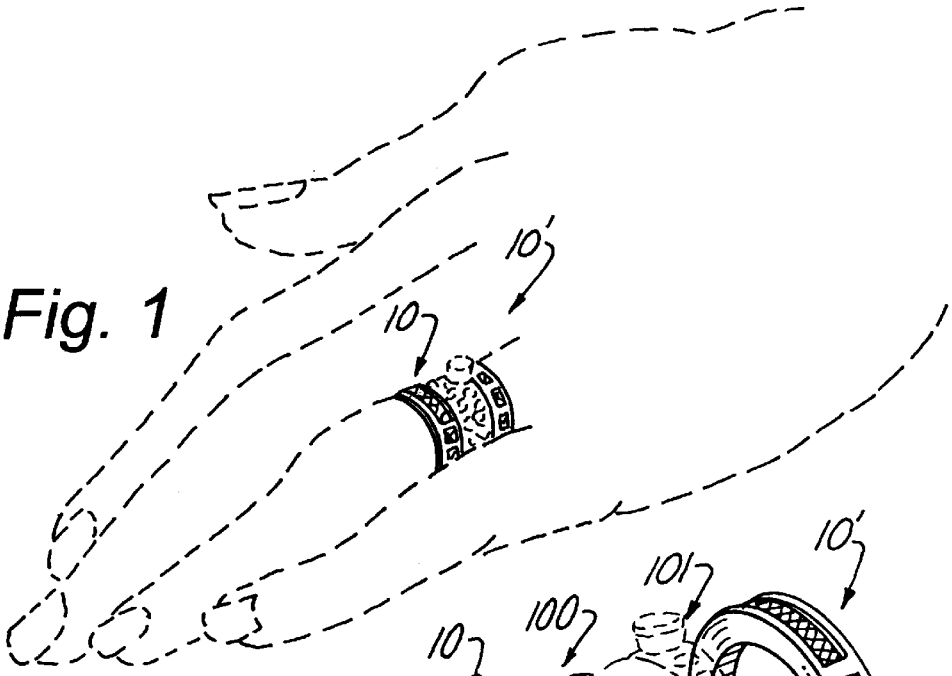
FIG. 1 a perspective view of a pair of mourning rings disposed on the user's hand.

As can be seen by reference to the drawings, and in particularly to FIG. 1, the mourning ring construction that forms the basis of the present invention is designated generally by the reference number 10. The construction 10 comprises in general, a ring body unit 11, a closure unit 12, a hidden message unit 13, and a connector unit 14. These units will now be described in seriatim fashion.

As can be seen by reference to FIGS. 2 through 4, the ring body unit 11 comprises a generally C-shaped ring body member 20 fabricated from metal and having an enlarged peripheral opening 21 whose purpose and function will be described in greater detail presently.

Figure 3:
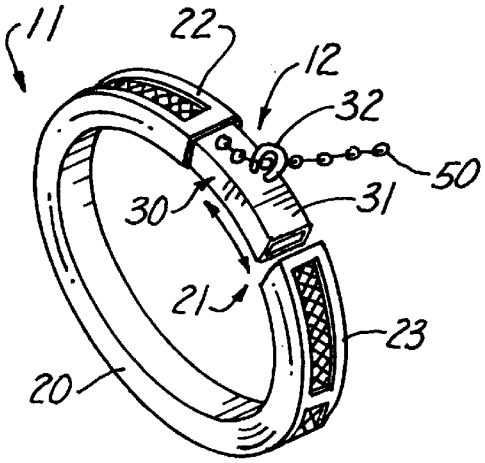
FIG. 3 is an isolated perspective view of the bottom of the mourning ring.

As can best be seen by reference to FIG. 3, the closure unit 12 comprises a sleeve member 30 operably attached and slidably disposed on one arm 22 of the ring body member 20 and dimensioned to slidably engage the other arm 23 of the ring body member 20 to complete the normal circular ring configuration.

In addition, the outboard surface 31 of the sleeve member 30 is provided with a discrete loop element 32 whose purpose and function will be described in greater detail further on in the specification.

Figure 4:
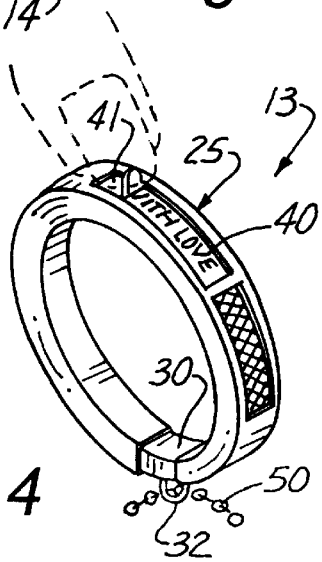
FIG. 4 is an isolated perspective view of the top of the mourning ring.

Turning now to FIG. 4, it can be seen that the outer intermediate portion of the C-shaped ring body member 20 is hollow and provided with a compartment 25 that cooperates with the hidden message unit 13. The hidden message unit 13 in turn comprises a printed message strip 40 that is dimensioned to be received in the ring body compartment 25. The message strip 40 is selectively obscured by a cover element 41 that is slidably disposed relative to the opening of the ring compartment 25.

Figure 2:
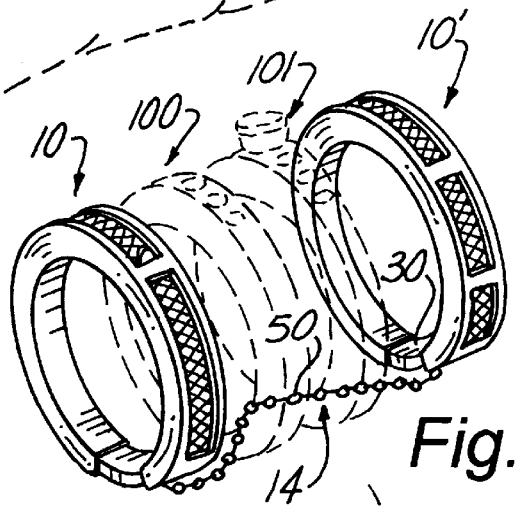
FIG. 2 is an isolated perspective view of a pair of mourning rings flanking a user's wedding and engagement rings.

Turning now to FIG. 2, it can be seen that the connector unit 14 comprises a length of chain 50 that can either be threaded through or connected directly to the loop element 32 on the sleeve member 30 whereby a plurality of ring constructions 10, 10' may be connected together in a flanking relationship relative to a wedding ring 100 and/or engagement ring 101 to indicate the passing of a spouse or fiance.

In the alternative, the mourning ring construction 10 can be worn alone on a different finger to indicate the passing of a close friend or family member and serve as a visible tribute for the deceased person.

It should further be noted that even though the ring construction 10 illustrated in the drawings shows substantial segments lined for the color black that is for illustration purposes only and in the preferred embodiment of this invention, the ring construction would be solid black in color.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A ring construction for providing a visual indication that the wearer of the ring is mourning or honoring the memory of a deceased loved one wherein the ring construction consists of:

a ring body unit including a generally C-shaped ring body member having an outer periphery and opposed arms which define an enlarged peripheral opening:

a closure unit including a slidable sleeve member operatively attached to one of the arms of the ring body unit and slidably engageable with the other arm of the ring body unit, wherein the closure unit has an outer periphery which is provided with a discrete loop element; and, wherein the slidable sleeve member is dimensioned to extend across the enlarged peripheral opening; and, a hollow compartment formed in the outer periphery of the ring body unit and dimensioned to receive a printed message strip wherein the hollow compartment further includes a slidable, retractable cover member for selectively uncovering the message strip.

2. The ring construction as in claim 1 wherein at least said ring body unit is solid black in color.

3. The ring construction as in claim 1 wherein at least said ring body unit is substantially black in color.

4. The ring construction as in claim 1 further including another identical ring construction and further consisting of:

a connector unit including a length of chain having opposite ends that are adapted to be operatively associated with the loop elements on the pair of identical ring constructions for connecting the pair of ring constructions together.

* * * * *